United States Patent [19]

Allain et al.

[11] 4,140,491

[45] Feb. 20, 1979

[54] GASOLINE ADDITIVE COMPRISING A BLEND OF METHYLCYCLOPENTADIENYL MANGANESE TRICARBONYL AND CERTAIN METHYLCYCLOPENTADIENE DIMER COMPOUNDS

[75] Inventors: Ronald J. Allain, Richmond; Ansell L. Reid, Sugar Land, both of Tex.

[73] Assignee: Nalco Chemical Company, Oak Brook, Ill.

[21] Appl. No.: 853,615

[22] Filed: Nov. 21, 1977

[51] Int. Cl.[2] ..... C10L 1/18

[52] U.S. Cl. ..... 44/56; 44/68

[58] Field of Search ..... 44/56, 68, 80; 260/666 PY

[56] References Cited

U.S. PATENT DOCUMENTS

| | | | |
|---|---|---|---|
| 3,002,829 | 10/1961 | Kolfenboch et al. | 260/683.9 |
| 3,113,419 | 12/1963 | Koch | 44/80 |
| 3,113,420 | 12/1963 | Wineman | 44/80 |
| 3,113,422 | 12/1963 | Wineman | 44/80 |
| 3,127,351 | 3/1964 | Brown et al. | 44/68 |
| 3,328,440 | 6/1967 | Shapiro et al. | 44/68 |
| 4,059,644 | 11/1977 | Cannell | 260/666 PY |

*Primary Examiner*—Winston A. Douglas
*Assistant Examiner*—Y. Harris-Smith
*Attorney, Agent, or Firm*—John G. Premo; Robert A. Miller

[57] ABSTRACT

Gasoline containing an additive comprising about 70% by weight of methylcyclopentadienyl manganese tricarbonyl and about 30% of a composition selected from the group consisting of methylcyclopentadiene dimer compounds, hydrogenated methylcyclopentadiene dimer compounds, and the alcohols of methylcyclopentadiene dimer compounds, said additive being present in the gasoline in an amount sufficient to increase its anti-knock effectiveness.

4 Claims, No Drawings

GASOLINE ADDITIVE COMPRISING A BLEND OF METHYLCYCLOPENTADIENYL MANGANESE TRICARBONYL AND CERTAIN METHYLCYCLOPENTADIENE DIMER COMPOUNDS

INTRODUCTION

Methylcyclopentadienyl manganese tricarbonyl, hereafter referred to as MMT, is a compound with known gasoline anti-knock properties. This usage of MMT is described in U.S. Pat. No. 3,127,351. This patent shows that as little as 0.1 gram per gallon up to 6.0 grams per gallon of the manganese contained in MMT is a far more effective anti-knock agent than the well-known anti-knock compounds, tetramethyl lead and tetraethyl lead.

While MMT is a superior anti-knock and is capable of improving the octane number of gasoline motor fuels when only small amounts are combined therewith, it has the disadvantage in relation to the other known anti-knock agents, such as the organo lead compounds, of being extremely difficult to prepare, thereby making it a costly material to purchase and add to gasoline.

If it were possible to provide an anti-knock composition whereby MMT was able to effectuate octane improvement in gasolines using smaller quantities thereof, a substantial improvement in this area of the art would be afforded.

THE INVENTION

In accordance with the invention, it has been found that an improved additive composition for improving the anti-knock characteristics of gasoline, e.g. its octane number (research,) is provided by combining with about 70% by weight MMT about 30% by weight of either methylcyclopentadiene dimer compounds (hereafter referred to as MeCPD,) hydrogenated MeCPD, or the alcohol of MeCPD. This combination anti-knock additive provides a superior anti-knock composition for treating motor fuels boiling within the gasoline range.

One of the primary advantages achieved by the practice of the invention is that it is possible to prepare the combination treatment by using a standard synthetic route used to prepare the MMT itself. The blend of MMT and MeCPD is, in effect, produced in situ.

MMT may be produced by reacting bis-(methylcyclopentadienyl) manganese with carbon monoxide in the presence of a solvent under pressure for a period of time sufficient to convert the manganese compound into its tricarbonyl compound. This reaction is described in substantial detail in U.S. Pat. No. 2,818,417, the disclosure of which is incorporated herein by reference. The conversion of the bis-(methylcyclopentadienyl) manganese to its corresponding tricarbonyl produces a reaction mixture which contains approximately 70% of MMT with the balance being MeCPD. In commercial practice, the MMT is normally separated from the MeCPD by high temperature and high vacuum distillation techniques which add substantially to the cost of the finished MMT.

In the process of this invention, after the solvent is removed from the two components, they may be used as such in the practice of the invention, e.g. the addition to gasoline to produce an improved gasoline having an increased octane rating.

Since the MeCPD is a bicyclic unsaturated material, there is some indication that prolonged use of this material in combination with gasoline as a fuel for internal combustion engines tends to produce a certain amount of gummy residues in the engine which sometimes are undesirable. To overcome this drawback of the compositions of the invention, it has been found that the unsaturation of the MeCPD may be eliminated if after the reaction mixture previously described is prepared, that it be subjected to a simple hydrogenation step which removes large portion of the double bonds contained in the MeCPD. Alternatively, after the reaction is finished, the mixture of MMT and MeCPD may be then subjected to an acid hydrolysis step which converts a substantial portion of the double bonds in the MeCPD to alcohol groupings.

In order to further illustrate the invention, the following are presented by way of example.

PREPARATION OF TWO MOLES OF MMT

EXAMPLE I-A

Preparation of methylcyclopentadienyl sodium

A three-liter creased flask equipped with stirrer, addition funnel, condenser, thermometer, gas inlet and outlet, and means for heating was charged with four moles of freshly chipped sodium and 667 grams of anhydrous DETEG*. The system was then purged with argon and the temperature then brought to 195° C. At about 120° C. vigorous stirring is applied. At 195° C. 2.2 moles of MeCPD is added dropwise while maintaining 195° - 200° C. When hydrogen evolution ceases, the reaction is complete and the solution is cooled to 65° - 70° C. for transfer to the autoclave. The methylcyclopentadienyl sodium is air sensitive and should be handled accordingly.

*Diethyl ether of tetraethylene glycol

EXAMPLE I-B

Preparation of bis-(methylcyclopentadienyl) manganese

The methylcyclopentadienyl sodium, a complete two-liter autoclave, and 2.06 moles of anhydrous manganous chloride were placed in a large glove bag and the bag thoroughly purged. The methylcyclopentadienyl sodium is then charged to the autoclave followed by the manganous chloride. The autoclave is then sealed and removed from the glove bag and placed in the heater. The temperature is then brought to 150° C. and held at that temperature for one hour. At the end of one hour, the reaction is complete. The bis-(methylcyclopentadienyl) manganese intermediate is spontaneously combustible upon contact with air. We found no need to isolate the compound.

EXAMPLE I-C

Preparation of methylcyclopentadienyl manganese tricarbonyl

When the preparation of bis-(methylcyclopentadienyl) manganese is complete, carbon monoxide is added until 500 psig is reached. The autoclave is held at this temperature and pressure for eight hours. Carbon monoxide will be taken up as evidenced by a reduction in pressure and will have to be repressurized occasionally. At the end of eight hours, the reaction is complete. This gives a black mixture comprised of approximately 7% MeCPD, 32% MMT, 61% DETEG, and solids. The material produced in Example I-C above is then steam distilled to separate the MMT and MeCPD from the solvent DETEG, thereby producing a finished semisolvent material which may be used as such as a gasoline additive in the practice of the invention.

EXAMPLE II

Hydrogenation of methylcyclopentadiene dimer (MeCPD)

If desired, the MeCPD formed in the reaction can be hydrogenated before isolation of the products. To hydrogenate the dimer, we used Raney nickel, 10% based on dimer. The catalyst was washed repeatedly with anhydrous DETEG before use. After completion of the MMT preparation, the autoclave was cooled and the catalyst added. The temperature was then brought to 175° C. and the hydrogen added to 500 psig. The autoclave was held at this temperature and pressure for about eight hours. These conditions will reduce one of the double bonds. To reduce the other double bond requires 1000 psig hydrogen pressure. The products are isolated by steam distillation. The overhead will initially be rich in hydrogenated MeCPD and become progressively rich in MMT as the distillation progresses. The product will contain very little unreacted MeCPD.

EXAMPLE III

Conversion of the methylcyclopentadiene dimer to the alcohol

If the dimer formed from the MMT preparation is to be converted to the alcohol, the pH of the aqueous mixture is adjusted to less than 2 with mineral acid. Steam distillation is then begun. The products are separated from the water in a separatory funnel. The overhead is very rich in MeCPD alcohol at the beginning and becomes progressively richer in MMT as the distillation progresses. The product will contain very little MeCPD. A two-mole run requires approximately 16 – 24 hours to distill. If the distillation is carried out at a pH of less than 2, a mixture of the alcohols plus MeCPD and MMT will be obtained.

EXAMPLE IV

This example illustrates the improved octane ratings achieved when the additives of the invention are used to treat gasoline. The following samples were submitted for research octane number determination: MMT plus MeCPD, MMT plus MeCPD alcohol, MMT plus hydrogenation products, and pure MMT. All samples gave a significant increase in octane number at 0.125 grams of manganese per gallon. The results are:

| | |
|---|---|
| Clear additive-free gasoline | 92.0 |
| MMT plus MeCPD | 93.9 |
| MMT plus hydrogenated MeCPD | 93.7 |
| MMT plus alcohol of MeCPD | 93.7 |
| Pure MMT | 93.7 |

The invention is subject to variations. For example, pure MMT may be physically blended with MeCPD which can be produced separately by several well-known processes. Thus, the invention is not limited to the simultaneous production of the MMT and the MeCPD. Similarly, the MeCPD can be isolated as a pure compound and subject to either hydrogenation or hydrolysis to produce the alcohol derivatives thereof which may be then physically blended with the MMT and the proportions previously recited herein.

Having thus described our invention, it is claimed as follows:

1. Gasoline containing an additive comprising about 70% by weight of methylcyclopentadienyl manganese tricarbonyl and about 30% of a composition selected from the group consisting of methylcyclopentadiene dimer, hydrogenated methylcyclopentadiene dimer, and the alcohols of methylcyclopentadiene dimer, said additive being present in the gasoline in an amount sufficient to increase its anti-knock effectiveness.

2. The gasoline of claim 1 where composition is methylcyclopentadiene dimer.

3. The gasoline of claim 1 where the composition is hydrogenated methylcyclopentadiene dimer.

4. The gasoline of claim 1 where the composition is the alcohols of methylcyclopentadiene dimer.

* * * * *